US008096817B2

(12) United States Patent
Lee et al.

(10) Patent No.: US 8,096,817 B2
(45) Date of Patent: Jan. 17, 2012

(54) ROTATABLE AND FOLDABLE ELECTRICAL PLUG CONNECTOR

(75) Inventors: Yu-Lung Lee, Nanfu Village (TW); Jung-Hui Hsu, Sinjhuang (TW); Ming-Chou Kuo, Taipei (TW); Mei-Ju Lin, Tucheng (TW)

(73) Assignee: Powertech Industrial Co., Ltd. (TW)

( * ) Notice: Subject to any disclaimer, the term of this patent is extended or adjusted under 35 U.S.C. 154(b) by 58 days.

(21) Appl. No.: 12/694,535

(22) Filed: Jan. 27, 2010

(65) Prior Publication Data

US 2011/0097914 A1 Apr. 28, 2011

(30) Foreign Application Priority Data

Oct. 28, 2009 (TW) ..... 98136466 A

(51) Int. Cl.
*H01R 29/00* (2006.01)

(52) U.S. Cl. ..... 439/104; 439/21; 439/131; 439/640

(58) Field of Classification Search ..... 439/131, 439/172, 640, 11, 13, 21, 104, 173
See application file for complete search history.

(56) References Cited

U.S. PATENT DOCUMENTS 3,780,260 A * 12/1973 Elsner ..... 392/392
4,743,999 A * 5/1988 Hames ..... 361/56
5,352,122 A * 10/1994 Speyer et al. ..... 439/13
5,613,863 A * 3/1997 Klaus et al. ..... 439/131
5,683,254 A * 11/1997 Lin ..... 439/11
6,089,921 A * 7/2000 Chou ..... 439/640
6,093,028 A * 7/2000 Yang ..... 439/13
6,302,743 B1 * 10/2001 Chiu et al. ..... 439/652
6,669,495 B2 * 12/2003 Philips et al. ..... 439/170
6,821,134 B2 * 11/2004 Chen ..... 439/131
6,853,801 B2 * 2/2005 Wefler ..... 392/392
6,862,403 B2 * 3/2005 Pedrotti et al. ..... 392/395
6,942,508 B2 * 9/2005 Wong ..... 439/171
7,125,257 B1 * 10/2006 Liang ..... 439/22
7,156,673 B2 * 1/2007 Son ..... 439/131
7,255,568 B1 * 8/2007 Wu et al. ..... 439/23
7,381,059 B2 * 6/2008 Wong ..... 439/22
7,484,972 B1 * 2/2009 Kuo et al. ..... 439/131
7,632,119 B1 * 12/2009 Ma et al. ..... 439/172
7,658,625 B2 * 2/2010 Jubelirer et al. ..... 439/131
7,845,951 B1 * 12/2010 Goon ..... 439/21
8,002,554 B2 * 8/2011 Wadsworth ..... 439/18
2006/0068608 A1 * 3/2006 McFadden ..... 439/22
2006/0089026 A1 * 4/2006 Song ..... 439/131
2011/0097911 A1 * 4/2011 Lee et al. ..... 439/108
2011/0097914 A1 * 4/2011 Lee et al. ..... 439/174

* cited by examiner

*Primary Examiner* — Neil Abrams
(74) *Attorney, Agent, or Firm* — Cantor Colburn LLP

(57) ABSTRACT

An electrical plug connector includes a rotary assembly, an electrical plug assembly having a live prong assembly, a neutral prong assembly, and a ground prong assembly and capable of rotating with respect to a first predetermined axis, and a linkage portion between the rotary assembly and the electrical plug assembly for linking the live prong assembly, the neutral prong assembly, and the ground prong assembly. The linkage portion is configured to enable the live prong assembly, the neutral prong assembly, and the ground prong to rotate with respect to a first predetermined axis simultaneously. When not so linked the three prongs may be folded into receiving spaces on the plug connector.

19 Claims, 5 Drawing Sheets

ROTATABLE AND FOLDABLE ELECTRICAL PLUG CONNECTOR

BACKGROUND OF THE INVENTION

1. Field of the Invention

The present invention relates to an electrical plug connector, and more particularly, to an electrical plug connector with foldable conducting prongs.

2. Description of Related Art

With advancement of the society, electronic devices have been becoming a fixture in people's daily lives. However, no global power supply safety standard has been put in place. And thus the standards and specifications of electrical outlets are different in different countries and areas. To accommodate the electrical outlets of different standards, two-prong or three-prong electrical plug connectors have been developed. Even so, either the two-prong connectors or the three-prong ones are limited in their applications. For example, the three-prong connectors may not be plugged into two-slot electrical outlets without usage of converters. Similarly, without the converters of the three-prong connectors may not be inserted into conventional two-slot electrical outlets either.

At the same time, portability of the electronic devices has been one of critical issues to be resolved in order to meet increasing demands associated with rapid developments thereof. A frequent traveler may have to carry an electric plug connector compatible with the different requirements of the electrical outlets so as to facilitate the idea of the portability of the electronic devices. However, whatever the number of the conductive prongs of the conventional electrical plug connector is they are configured to be in a firm attachment to a base of the plug connector, decreasing the flexibility of the electrical plug connector when it is to be inserted into the electrical outlets of different number of the slots.

SUMMARY OF THE INVENTION

An electrical plug connector according to the present invention includes a rotary assembly, an electrical plug assembly, and a linkage portion. The electrical plug assembly is configured to rotate with respect to a first predetermined axis while the rotary assembly is configured to rotate with respect to a second predetermined axis wherein the second predetermined axis is substantially perpendicular to the first predetermined axis. The electrical plug assembly further includes a live prong assembly, a neutral prongs assembly, and a ground prong assembly. The linkage portion, which is disposed between the ground prong assembly, the live prong assembly and neutral prong assembly, is configured to control an engagement or disengagement between the live prong assembly, the neutral prong assembly, and the ground prong assembly. As such, the ground prong assembly may rotate along with the live prong assembly and the neutral prong assembly simultaneously.

Meanwhile, the ground prong assembly may not rotate along with the live prong assembly and the neutral prong assembly, enabling the electrical plug connector with the live prong assembly, the neutral prong assembly, and the ground prong assembly to be inserted into a two-slot electrical outlet.

In order to further understand the techniques, means and effects the present invention takes for achieving the prescribed objectives, the following detailed description and included drawings are hereby referred, such that, through which, the purposes, features and aspects of the present invention can be thoroughly and concretely appreciated; however, the included drawings are provided solely for reference and illustration, without any intention to be used for limiting the present invention, whose full scope and dimension is described only in the later following claims.

DETAILED DESCRIPTION OF THE PREFERRED EMBODIMENTS

Figure 1:
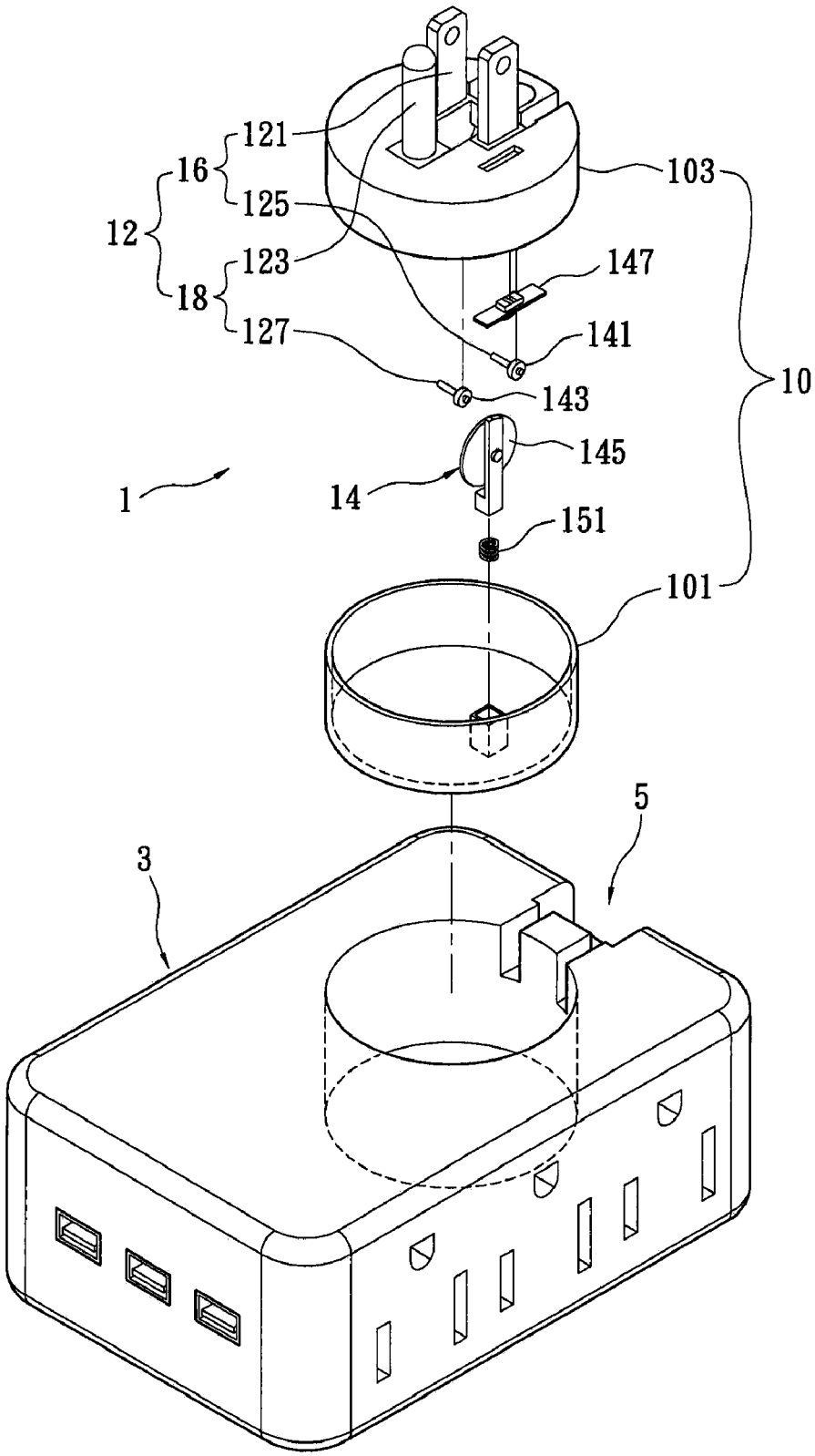
FIG. 1 illustrates an exploded diagram of an electrical plug connector in accordance with certain aspects of the present technique.

Please refer to FIG. 1 illustrating an exploded diagram of an electrical plug connector in accordance with certain aspects of the present technique. The electrical plug connector 1 includes a rotary assembly 10, an electrical plug assembly 12, and a linkage portion 14. The rotary assembly 10 further includes a base 101 and a rotating member 103, and the electrical plug assembly 12 further includes live and neutral prongs 121 (including a live prong and a neutral prong), a ground prong 123, a first shaft 125 and a second shaft 127. The linkage portion 14 further includes a first gear 141, a second gear 143, a linkage gear 145 and a control switch 147.

The electrical plug assembly 12 is disposed onto the rotary assembly 10 and is rotatable with respect to a first predetermined axis. The direction of the first predetermined axis may be parallel to a longitudinal axis of the first shaft 125 of the electrical plug assembly 12. The electrical plug assembly 12 can also be categorized into two major portions including a live and neutral prongs assembly 16 and a ground prong assembly 18. The live and neutral prongs 121 and the ground prong 123 are made of conductive metal material for electrically connecting to conductive wires. The live and neutral prongs 121 and the shaft 125 consist of the live and neutral prongs assembly 16. The ground prong 123 and the second shaft 127 consist of the ground prong assembly 18. The ground prong assembly 18 is rotatable with respect to the first predetermined axis. In one implementation, the first predetermined axis may be substantially parallel to a longitudinal axis of the second shaft 127 of the electrical plug assembly 12.

The rotary assembly 10 is configured to be a three-layer structure, and each layer includes an insulating sheet and a conducting sheet on the insulating sheet. Each conducting sheet contacts with the conducting prongs and the three layers are stacked and engaged together. And the three layers may form a rotating member so as to rotate simultaneously. The base 101 of the rotary assembly 10 is attached onto a main body 3. The rotating member 103 is disposed onto the base 101 and is configured to have the electrical plug assembly 12 disposed thereon. While the rotating member 103 rotates, the electrical plug assembly 12 disposed on the base 101 may rotate as well. It is worth noting that the rotating member 103 may rotate with respect to a second predetermined axis. In one implementation, the second predetermined axis may be perpendicular to the first predetermined axis. The rotating member 103, as well as the rotary assembly 10, may rotate in any angle transversely. In other words, the rotating member 103 and the rotary assembly 10 may rotate the entire 360 degrees. As such, the electrical plug assembly 12 may rotate with respect to not only the first predetermined axis but also the second predetermined axis.

The linkage portion 14 is disposed between the live and neutral prongs assembly 16 and the ground prong assembly 18 so as to control a linkage associated with the live and neutral prongs assembly 16 and the ground prong assembly 18. The first gear 141 of the linkage portion 14 is placed beneath the live and neutral prongs assembly 16. The second gear 143 of the linkage portion 14 is placed beneath the ground prong assembly 18. The linkage gear 145 is placed on the rotating member 103 and between the first gear 141 and the second gear 143. The linkage gear 145 further includes an elastic element 151 disposed between the base 101 and the linkage gear 145. A control switch 147 is for controlling whether the elastic element 151 is in a first state. In one implementation, the first state is either a relaxed state or a compressed state.

Figure 2:
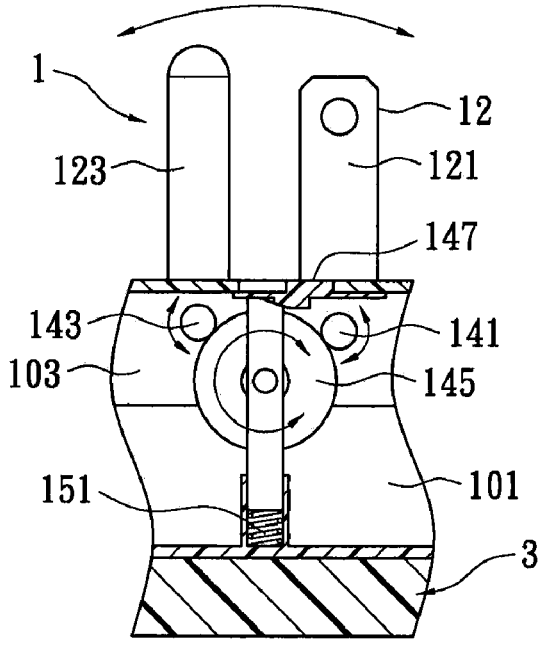
FIG. 2 illustrates a first cross-sectional view of an electrical plug connector according to one embodiment of the present invention.
Figure 3:
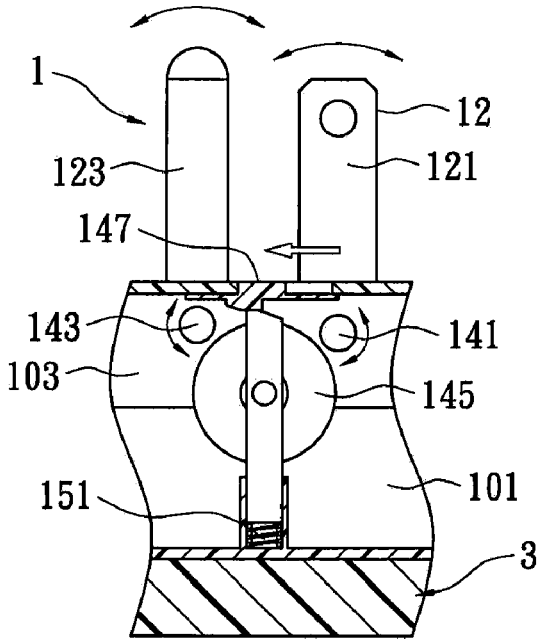
FIG. 3 illustrates a second cross-sectional view of an electrical plug connector according to one embodiment of the present invention.

Please refer to FIG. 2 and FIG. 3 illustrating a first cross-sectional view and a second cross-sectional view of an electrical plug connector according to one embodiment of the present invention. As shown in FIG. 2, while the control switch 147 manipulates the displacement of the linkage gear 145 to render the elastic element 151 in a relaxed state, the linkage gear 145 may be engaging with the first gear 141 and the second gear 143 as the result of the push from the elastic element 151. With the engagement between the linkage gear 145, the first gear 141, and the second gear 143, the live and neutral prongs assembly 16 along with the ground prong assembly 18 may rotate simultaneously as a single functional unit. As shown in FIG. 3, while the control switch 147 manipulate the displacement of the linkage gear 145 to render the elastic element 151 in a compressed state, the linkage gear 145 may disengage the first gear 141 and the second gear 143. Consequently, the live and neutral prongs assembly 16 and the ground prong assembly 18 may operate as individual functional units. In other words, the live and neutral prongs assembly 16 may not rotate along with the ground prong assembly 18.

Figure 4:
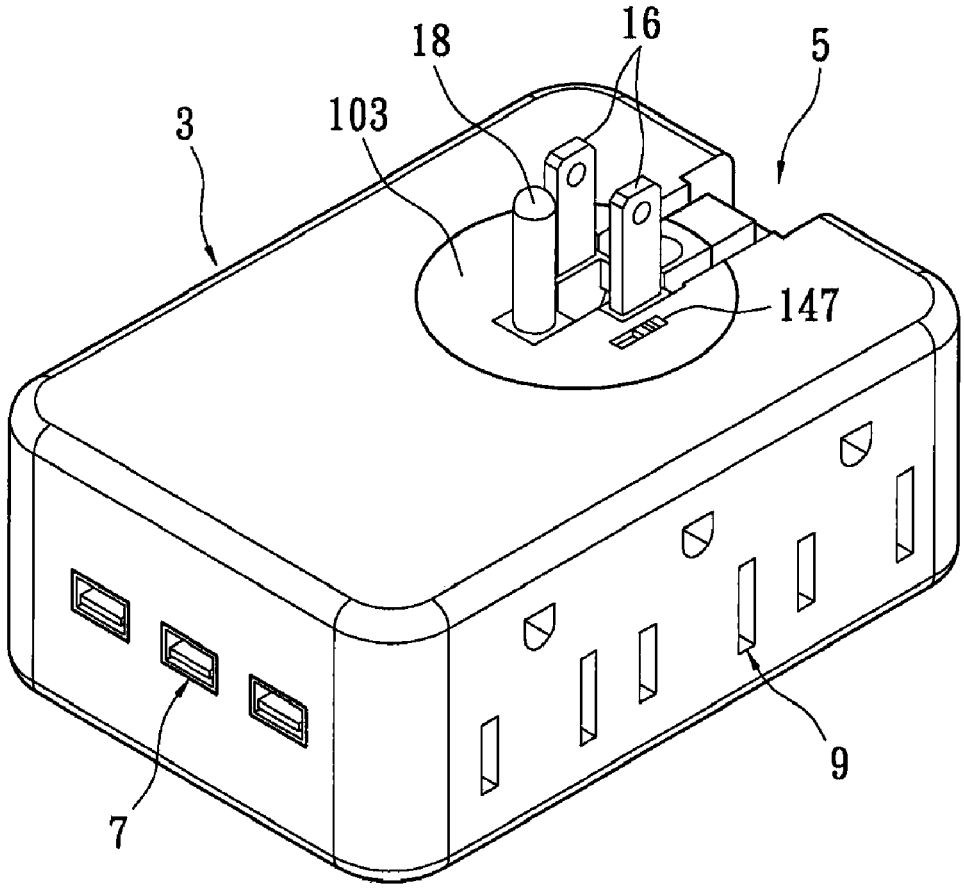
FIG. 4 illustrates a schematic diagram of an electrical plug connector in accordance with certain aspects of the present technique.

In conjunction with FIG. 1, FIG. 4 is a schematic diagram of an electrical plug connector in accordance with certain aspects of the present technique. The main body 3 has a predetermined accommodating opening 5 for substantially completely receiving a portion of the electrical plug assembly 12 extending outside of the rotary assembly 10, such that the exterior surface of the main body 3 is without any protruding portions. For example, as the control switch 147 manipulates the linkage gear 145 to be in engagement with the first gear 141 and the second gear 143, which causes the live and neutral prongs assembly 16 and the ground prong assembly 18 to rotate to a specific position where the live and neutral prong assembly 16 and the ground prong assembly 18 could be received into the accommodating opening 5. When the control switch 147 manipulates the linkage gear 145 to disengage the first gear 141 and the second gear 143, the live and neutral prongs assembly 16 could rotate to a predetermined location where the live and neutral prong assembly 16 may still extend outside of the main body 3 while the ground prong assembly 18 may rotate to another predetermined location in order to be received within the accommodating opening 5. As such, with the ground prong being folded the electrical plug connector 1 with three conducting prongs could be inserted into the two-slot electrical outlets. Thus, it is worth noting that the live and neutral prongs assembly 16 and the ground prong assembly 18 may not rotate the entire 360 degrees.

When either or both of the live and neutral prongs assembly 16 and the ground prong assembly 18 are received within the accommodating opening 5, the rotation of the rotary assembly 10 may be restricted. Moreover, the electrical plug connector 1 could be equipped with an electrical outlet assembly 9 and a USB jack assembly 7. The electrical outlet assembly 9 and the USB jack assembly 7 are coupled to the electrical plug assembly 12 respectively, so that the power source can be provided to the electrical outlet assembly 9 and the USB jack assembly 7 through the electrical plug assembly 12. The electrical outlet assembly 9 may contain a plurality of three-slot or two-slot electrical outlets, and the USB jack assembly 7 may contain a plurality of USB jacks so as to enhance functionalities of the electrical plug connector 1.

Figure 5:
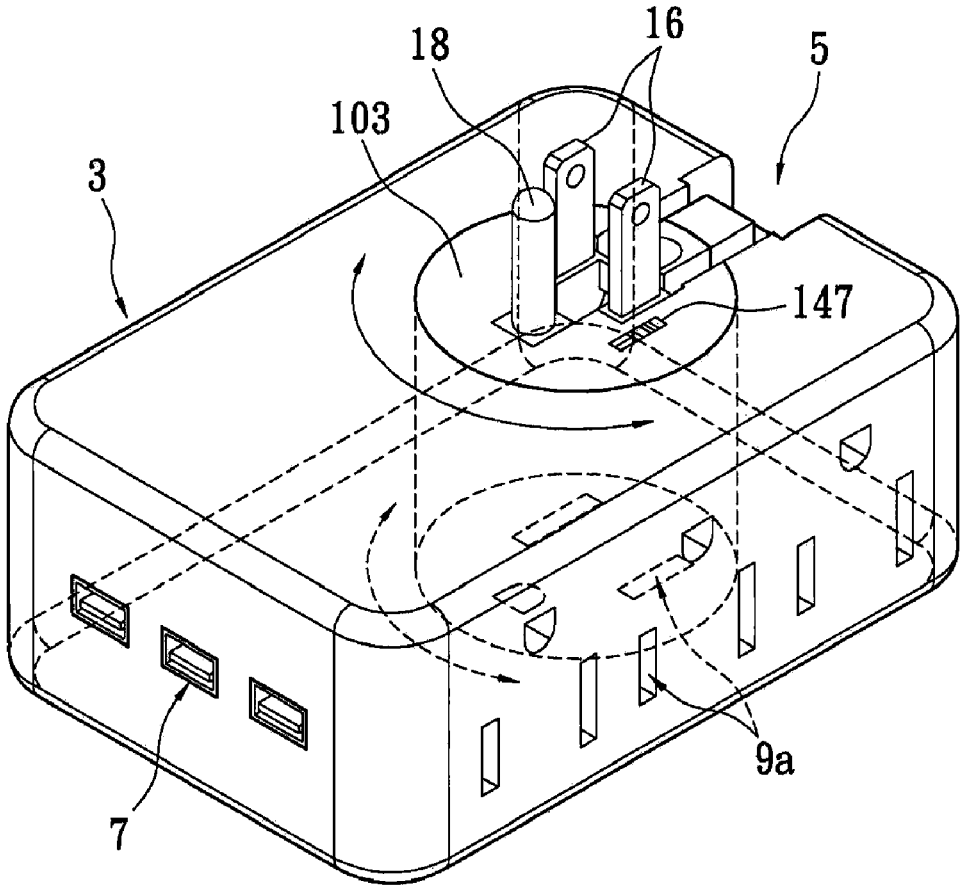
FIG. 5 illustrates a schematic diagram of an electrical plug connector in accordance with certain aspects of the present technique.

In conjunction with FIG. 1 and FIG. 4, FIG. 5 is a schematic diagram of an electrical plug connector in accordance with certain aspects of the present technique. The electrical plug connector may have an electrical outlet assembly 9*a* and a USB jack assembly 7*a* on the main body 3. The electrical outlet assembly 9*a* and the USB jack assembly 7*a* are coupled to the electrical plug assembly 12 respectively, so that the power source can be provided to the electrical outlet assembly 9*a* and the USB jack assembly 7*a* through the electrical plug assembly 12. The location and number of the electrical outlet assembly 9*a* and the USB jack assembly 7*a* are merely for illustration, without any intention to limit the scope of the present invention. For example, an electrical outlet assembly 9*a* is disposed on a bottom side of the rotary assembly 10 while the electrical plug assembly 12 is disposed on a top side thereof. As a result, when the electrical plug assembly 12 is linked to the rotary assembly 10 through any means known to the people having the ordinary skills in the art the rotation of the rotary assembly 10 may cause the electrical plug assembly 12 and the electrical outlet assembly 9*a* to rotate as well.

Figure 6:
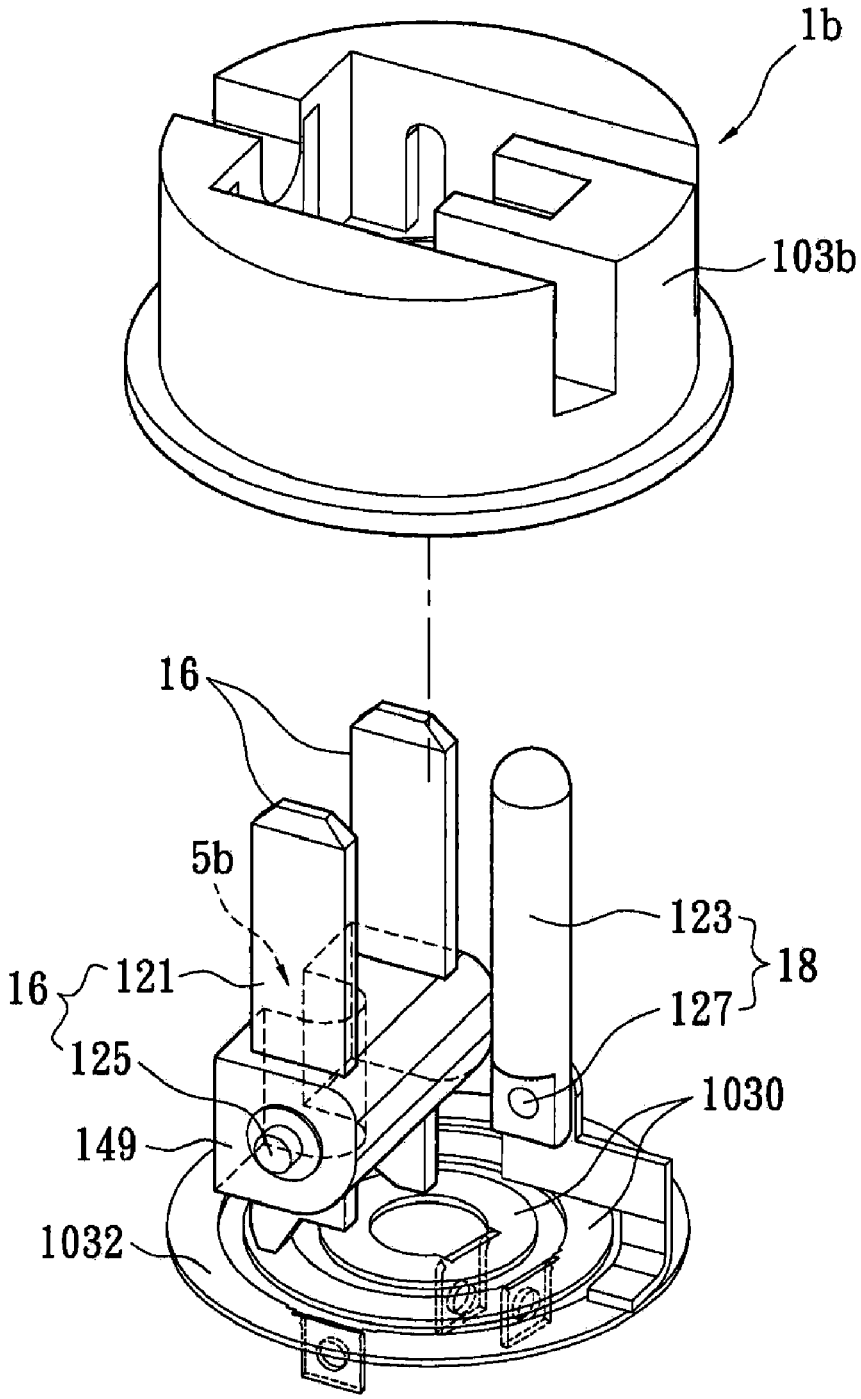
FIG. 6 illustrates a schematic diagram of an electrical plug connector in accordance with certain aspects of the present technique.

Please refer to FIG. 6 of a schematic diagram of an electrical plug connector in accordance with certain aspects of the present technique. A live and neutral annular contact member 1030 that is coupled to the live and neutral prongs 121 for conducting is disposed inside the rotating member 103*b*, so that alternating current (AC) electric power source can supply electricity to the live and neutral prongs 121 via the live and neutral annular contact member 1030. A ground annular contact member 1032, meanwhile, is coupled to the ground prong 123 for grounding.

Moreover, the linkage portion of the electrical plug connector 1*b* a shown in FIG. 6 may be an insulated mechanical linkage 149 disposed between the live prong assembly and the neutral prong assembly 16, so as to enable the linkage associated with the live prong assembly and the neutral prong assembly 16. Thus, the ground prong assembly 18 may rotate with respect to a predetermined axis so that it could be received within the rotating member 103*b* without protruding out of the rotating member 103*b*. With the ground prong received within the rotating member 103*b*, the electrical plug connector with three prongs may be inserted into the two-slot electrical outlet. The live and neutral prongs assembly that is linked by the insulating mechanical linkage 149 may rotate with respect to another predetermined axis so as to be received within the rotating member 103*b*.

The insulating mechanical linkage 149 may have an accommodating opening 5*b* between the live prong assembly and the neutral prong assembly 16. When the live and neutral prongs assembly 16 rotates clockwise, the ground prong assembly 18 may rotate counter-clockwise. As such, the ground prong assembly 18 may be received within accommodating opening 5*b*. Consequently, the electrical plug connector 1*b* may occupy a reduced space enabling the frequent travelers carrying it to utilize their luggage space in a more economical manner.

Moreover, the accommodating opening 5*b* disposed on the insulating mechanical linkage 149 is configured not affect or restrict the sequence of rotating of the conducting prongs assemblies including the live and neutral prongs assembly 16 and the ground prong assembly 18. For example, the ground prong assembly 18 may rotate first in order to be received within the rotating member 103*b*, and the live and neutral prongs assembly 16 may then rotate so as to be received into the rotating member 103*b* as well. Alternatively, the live and neutral prongs assembly 16 may be received into the rotating member 103*b* before the ground prong assembly 18. Because the accommodating opening 5*b* is on the insulating mechanical linkage 149, the rotating member 103*b* carrying the received live and neutral prongs assembly 16 and the ground prong assembly 18 may still rotate horizontally.

The aforementioned descriptions represent merely the preferred embodiment of the present invention, without any intention to limit the scope of the present invention thereto. Various equivalent changes, alterations, or modifications based on the claims of present invention are all consequently viewed as being embraced by the scope of the present invention.

What is claimed is:

1. An electrical plug connector, comprising:

a rotary assembly having a top surface configured to rotate about a second predetermined axis;

an electrical plug assembly disposed protrudingly from the top surface of the rotary assembly, the electrical plug assembly comprising:

a live and neutral prongs assembly including a live and a neutral prongs and a first shaft for pivotably coupling the live prong and the neutral prong and allowing the live and the neutral prongs to pitch with respect to the top surface of the rotary assembly; and a ground prong assembly including a ground prong and a second shaft for pivotably coupling the ground prong and allowing the ground prong to pitch with respect to the top surface of the rotary assembly, wherein the longitudinal axis of the first shaft and the second shaft are substantially parallel to each other and substantially perpendicular to the second predetermined axis; and a linkage portion disposed between the live and neutral prongs assembly and the ground prong assembly for linking the live and neutral prongs assembly and the ground prong assembly so as to configure the live and neutral prongs assembly and the ground prong assembly into individually pivoting units or a jointly pivoting unit.

2. The electrical plug connector according to claim 1, wherein the rotary assembly further includes:

a base on a main body of the rotary assembly; and a rotating member received by the base for accommodating the electrical plug assembly wherein the rotating member and the electrical plug assembly rotate with respect to the second predetermined axis simultaneously.

3. The electrical plug connector according to claim 2, wherein the rotating member further includes:

live and neutral annular contact members electrically connected to the live prong and the neutral prong for inputting an alternating current (AC) electrical power to the live prong and the neutral prong; and a ground annular contact member electrically connected to the ground prong for grounding the ground prong.

4. The electrical plug connector according to claim 3, wherein the linkage portion further includes:

a first gear coupled to the live and neutral prongs assembly;

a second gear coupled to the ground prong assembly;

a linkage gear, disposed between the first gear and the second gear, for linking the live and neutral prongs assembly and the ground prong assembly; and a control switch for controlling an engagement or a disengagement between the linkage gear, the first gear, and the second gear.

5. The electrical plug connector according to claim 4, wherein the linkage gear includes an elastic element disposed between the base and the linkage gear wherein the control switch is configured to manipulate the elastic element into a first state so as to enable the engagement between the linkage gear, the first gear, and the second gear.

6. The electrical plug connector according to claim 5, wherein the control switch is configured to manipulate the elastic element into a second state so as to enable the disengagement between the linkage gear, the first gear, and the second gear.

7. The electrical plug connector according to claim 6, wherein the main body has a predetermined accommodating opening for receiving the electrical plug assembly in order to avoid the electrical plug assembly from extending outside of the main body.

8. The electrical plug connector according to claim 3, wherein the linkage portion is an insulated mechanical linkage disposed between the live prong assembly and the neutral prong assembly.

9. The electrical plug connector according to claim 8, wherein the insulated mechanical linkage has a predetermined accommodating opening for receiving the electrical plug assembly in order to avoid the electrical plug assembly from extending outside of the rotating member.

10. The electrical plug connector according to claim 7, wherein the main body is configured to have an electrical outlet assembly electrically coupled to the electrical plug assembly and a USB jack assembly coupled to the electrical outlet assembly, wherein the electrical outlet assembly includes a plurality of three-slot or two-slot electrical outlets, and the USB jack assembly includes a plurality of USB jacks.

11. The electrical plug connector according to claim 10, wherein the electrical outlet assembly is disposed on a first side of the rotary assembly and the USB jack assembly is disposed on a second side of the rotary assembly.

12. The electrical plug connector according to claim 9, wherein the main body is configured to have an electrical outlet assembly and a USB jack assembly, both of which are electrically coupled to the electrical plug assembly, wherein the electrical outlet assembly includes a plurality of three-slot electrical outlets or two-slot electrical outlets, and the USB jack assembly includes a plurality of USB jacks.

13. The electrical plug connector according to claim 12, wherein the electrical outlet assembly is disposed on a first other side of the rotary assembly while the USB jack assembly is disposed on a second side of the rotary assembly.

14. An electrical plug connector, comprising:

a main body having a top surface;

an electrical plug assembly disposed protrudingly from the top surface of the main body, the electrical plug assembly comprising:

a first prong assembly including at least one first prong and a first shaft pivotably coupling the at least one first prong, allowing the at least one first prong to pitch with respect to the top surface of the main body; and a second prong assembly including a second prong and a second shaft for pivotably coupling the second prong, allowing the second prong to pitch with respect to the top surface of the main body, wherein the longitudinal axis of the first shaft and the second shaft are substantially parallel to each other; and a linkage portion disposed between the first prong assembly and the second prong assembly for linking the first prong assembly and the second prong assembly so as to configure the first prong assembly and the second prong assembly into individually pivoting units or a jointly pivoting unit.

15. The electrical plug connector according to claim 14, wherein the linkage portion further includes:

a first gear coupled to the first prong assembly;

a second gear coupled to the second prong assembly;

a linkage gear, disposed between the first gear and the second gear, for linking the first prong assembly and the second prong assembly; and a control switch for controlling an engagement or a disengagement between the linkage gear, the first gear, and the second gear.

16. The electrical plug connector according to claim 15, wherein the linkage gear includes an elastic element disposed between the main body and the linkage gear, wherein the control switch is configured to manipulate the elastic element into a first state so as to enable the engagement between the linkage gear, the first gear, and the second gear.

17. The electrical plug connector according to claim 16, wherein the control switch is configured to manipulate the elastic element into a second state so as to enable the disengagement between the linkage gear, the first gear, and the second gear.

18. The electrical plug connector according to claim 15, wherein the first prong assembly includes a live prong and a neutral prong, wherein the linkage portion is an insulated mechanical linkage disposed between the live prong and the neutral prong.

19. The electrical plug connector according to claim 18, wherein the insulated mechanical linkage has an accommodating opening concavely formed at one side thereof for receiving the second prong assembly.

* * * * *